US005930928A

United States Patent [19]

Kantola et al.

[11] Patent Number: 5,930,928

[45] Date of Patent: Aug. 3, 1999

[54] FRONT-LOADING POSTER FRAME DEVICE

[76] Inventors: Thomas L. Kantola, 8377 Beverly Ann Way, Lindin, Mich. 48451; Ronald E. Grewe, 22437 Cranbrooke Dr., Novi, Mich. 48375; Ralph W. Dingle, 21675 Green Hill, Apt. 114, Farmington Hills, Mich. 48335

[21] Appl. No.: 08/924,576

[22] Filed: Sep. 5, 1997

[51] Int. Cl.[6] ..... G09F 1/12

[52] U.S. Cl. ..... 40/793; 40/611

[58] Field of Search ..... 40/792, 793, 794, 40/611, 590, FOR 156; 403/282, 279, 274

[56] References Cited

U.S. PATENT DOCUMENTS

| | | | |
|---|---|---|---|
| 3,726,000 | 4/1973 | Hafner | 29/21.1 |
| 4,145,828 | 3/1979 | Hillstrom | 40/156 |
| 4,519,152 | 5/1985 | Seely et al. | 40/156 |
| 4,523,400 | 6/1985 | Seely | 40/156 |
| 4,937,959 | 7/1990 | Palmer et al. | 40/156 |
| 4,958,458 | 9/1990 | Hillstrom et al. | 40/156 |
| 5,099,590 | 3/1992 | Yamaguchi | 40/156 |
| 5,307,575 | 5/1994 | Ivansson et al. | 40/156 |

FOREIGN PATENT DOCUMENTS

| | | | |
|---|---|---|---|
| 2565013 | 5/1984 | France | 40/156 |
| 2634043 | 8/1988 | France | 40/156 |
| 2223874 | 10/1988 | United Kingdom | 40/156 |

*Primary Examiner*—Brian K. Green

[57] ABSTRACT

A front-loading poster display device with a plurality of poster frame sections positioned around and connected to a backing member. Each of the frame sections have a base member affixed to the backing member and a spring-biased cover member rotatably attached to the base member. The ends of the frame sections are mitered at 45° angles. The backing member is preferably connected to the base members of each of the frame sections by "Tog-L-Locs" or other sheet metal joining mechanisms. The ball-type pintle formations in each of the hinge mechanisms connecting the base and cover members together can have one or more elongated slots or recesses therein.

7 Claims, 2 Drawing Sheets

FRONT-LOADING POSTER FRAME DEVICE

TECHNICAL FIELD

This invention relates to improved, low-cost front-loading picture and poster frames.

BACKGROUND OF THE INVENTION

There are various types of picture and poster frames in use today. Some of these are shown, for example, in U.S. Pat. Nos. 3,310,901, 4,041,632 and 4,145,828. Some common poster frame devices known today are front-loading frame devices, such as shown in U.S. Pat. Nos. 3,310,901 and 4,145,828. These devices have worked very well and have been commercially successful.

Most poster frame devices are square or rectangular in shape with four frame sections joined together in the four corners with corner keys or similar devices. The ends of the frame sections are typically mitered at 45° at the corners, or are cut at 90° and abut separate corner members. Poster frames with mitered corners are shown, for example, in U.S. Pat. No. 4,519,152, while poster frames with separate corner members are shown, for example, in U.S. Pat. No. 5,086,736. The corner keys and separate corner members add additional expense and assembly time to the frame devices.

Front-loading poster frames typically have frame sections with a pair of spring-biased rotating members, such as a cover member and a base member hingedly attached together. Where the cover and base members are made from metal materials, it has been found necessary to utilize rail locks or equivalent mechanisms in order to prevent the cover members from sliding longitudinally relative to the base members. These mechanisms include, for example, small threaded cylinders, material staking or swaging, and other interlocking mechanical mechanisms. See, for example, U.S. Pat. Nos. 4,937,959 and 4,958,458. These mechanisms also add expense and complexity to the total cost and assembly of the poster frames.

SUMMARY OF THE INVENTION

It is an object of the present invention to provide improved poster and picture frame devices. It is another object of the present invention to provide an improved poster display device which has frame sections mitered 45° at the corners and which does not utilize corner keys or similar mechanisms.

It is also an object of the present invention to provide a poster frame device which is front-loading, has rotating cover members attached to fixed base members, and which is simpler and more economical to manufacture. It is a further object of the present invention to provide a poster display device which does not need or utilize cover-base interlocking mechanisms and which does not experience longitudinal movement of the cover member versus the base member during use.

It is still another object of the present invention to provide a metal poster frame device which utilizes a minimum of parts and materials in order to save weight and material cost.

These and other objects and purposes of the present invention are achieved by the present invention. In this regard, the present invention comprises a poster frame device which comprises a plurality (preferably four) frame sections positioned around and fixedly attached to a backing member. Each of the frame sections comprise a fixed base member and a spring-biased cover member hingedly attached together to form a front-opening poster frame device.

The backing member is staked or otherwise mechanically secured to the base members of each of the frame sections and holds the frame sections together without corner keys or other corner members. Preferably, a "Tog-L-Loc" sheet metal joining system from BTM Corp., or similar stitching mechanism, is utilized. In this manner, the frame sections can be mitered 45° at their ends. The ends of the cover members are adapted to abut one another minimizing longitudinal sliding of the cover members relative to the base members. The cover members are spring-biased to the base members with one or more spring members.

These and other features, benefits and advantages of the present invention will become apparent from the following description of the invention, when viewed in accordance with the accompanying drawings and appended claims.

BEST MODES FOR CARRYING OUT THE INVENTION

Figure 1:
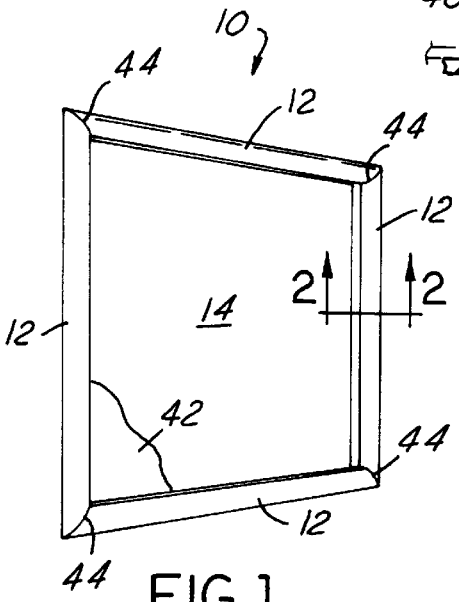
FIG. 1 illustrates a poster frame device in accordance with the present invention.

FIGS. 1–5 show the preferred form of the present invention. The poster frame device is generally indicated by the reference numeral 10. The frame device 10 can be used to hold and display posters, pictures, advertisements, photographs, or any other type of graphic pictorial or informational display materials. For simplicity, the device 10 will be referred to generally by the term "poster display device", but it is to be understood that such reference is not meant to be limiting. Also, for simplicity, the posters, pictures, and other materials which can be displayed in the poster display device will be referred to generally by the term "display member" or "posters", but again those terms are not meant to be limiting.

The poster display device 10 includes a plurality of frame sections 12 spaced around the periphery of a backing member 14. Typically, poster frame devices are rectangular or square in shape and have four frame sections 12. It is to be understood, of course, that other numbers of frame sections 12 could be utilized. Also, it is understood that the poster display device can have various sizes and shapes and does not have to be limited to square and rectangular shapes. Moreover, more than one frame section 12 can be provided on each of the edges of the backing member 14.

The poster frame device 10 is a "front-loading" device in which the frame sections open up in order to allow removal and replacement of a poster or display member 42 on top of the backing member 14. In this regard, a frame section is shown in its "closed" position in FIG. 2 and in its "open" position in FIG. 3.

Each of the frame sections 12 includes a base member 16 and a cover member 18 which is hingedly or pivotally attached to the base member. The base members 16 of the frame sections 12 are attached to the backing member 14 around its periphery. In this regard, the backing member 14 is preferably positioned in a slot or channel 20 that is formed between elongated flange 22 and smaller flange or protrusion 24.

Base member 16 and cover member 18 are pivotally attached together by hinge mechanism 26. Hinge mechanism 26 consists of a ball-type pintle formation 28 formed as part of the base member 16, as well as a concave mating curved pocket member 30 which is formed as part of the cover member 18. Preferably the base and cover members of each of the frame sections 12 are made from an extruded aluminum material. Also, the pintle member 28 preferably has a portion removed in order to save weight and cost. The removal of material from the pintle member 28 forms an elongated channel or slot 32 along the length of the pintle formation and saves material cost without sacrificing performance, strength, or durability.

Figure 6:
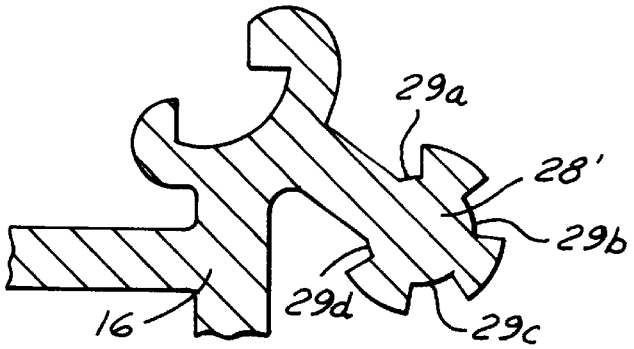
FIG. 6 illustrates an alternate embodiment of a hinge mechanism which can be used on the base member in accordance with the present invention.

An alternate embodiment of a pintle member 28' is shown in FIG. 6. With this pintle member 28', a plurality of elongated slots or grooves 29*a*, 29*b*, 29*c* and 29*d* are formed in the pintle member 28'. Depending on the number of elongated channels or slots 29*a*–29*d* and the depth thereof, significant savings in materials and cost can result with the present invention.

A spring member 34 is used to bias the base members 16 and cover members 18 together in each of the frame sections 12. The spring member 34 is preferably a piece of thin spring steel material and one or more members 34 are provided in each frame section, depending on the length thereof. The spring members 34 are positioned between channel 36 in the inner end 40 of cover member 18 and channel 38 formed in the base member 16.

Figure 2:
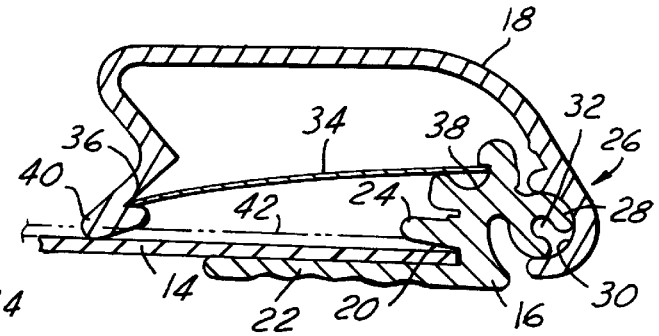
FIG. 2 is a cross-sectional view of the poster frame device shown in FIG. 1, the cross-section being taken along line 2—2 in FIG. 1 and in the direction of the arrows.
Figure 3:
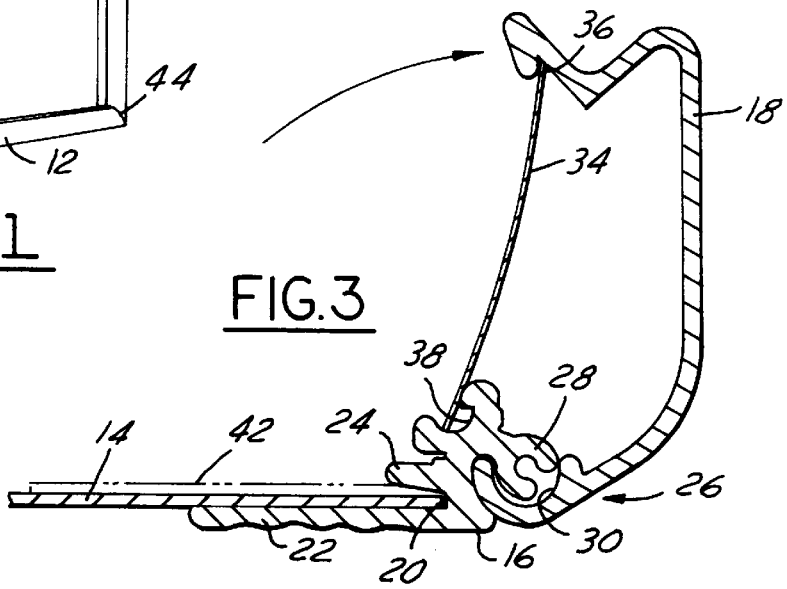
FIG. 3 is another view of the cross-section shown in FIG. 2, but with the cover member shown in its "open" position.

The spring members 34 bias the cover members 18 in an over-the-center spring force relationship with the base members 16. In this regard, when the frame section 12 is in its closed position, as shown in FIG. 2, the biasing spring member 34 holds the inner end 40 of the cover member 18 securely against the backing member 14. When a poster or display member 42 (shown in phantom lines in FIGS. 2 and 3) is positioned in the poster frame device 10, the cover members 18 around the periphery thereof securely hold the display member 42 in place in the poster frame device 10. When it is desired to remove or replace the display member 42, the cover member 18 is rotated to its open position, as shown in FIG. 3. In such a position, the spring member 34 holds the cover member 18 in its open position.

Further features of the base and cover members, as well as the operation thereof, are described in more detail in U.S. Pat. Nos. 3,310,901 and 4,145,828, both of which are commonly owned with the present invention. The disclosures of these patents are hereby incorporated by reference herein.

Figure 4:
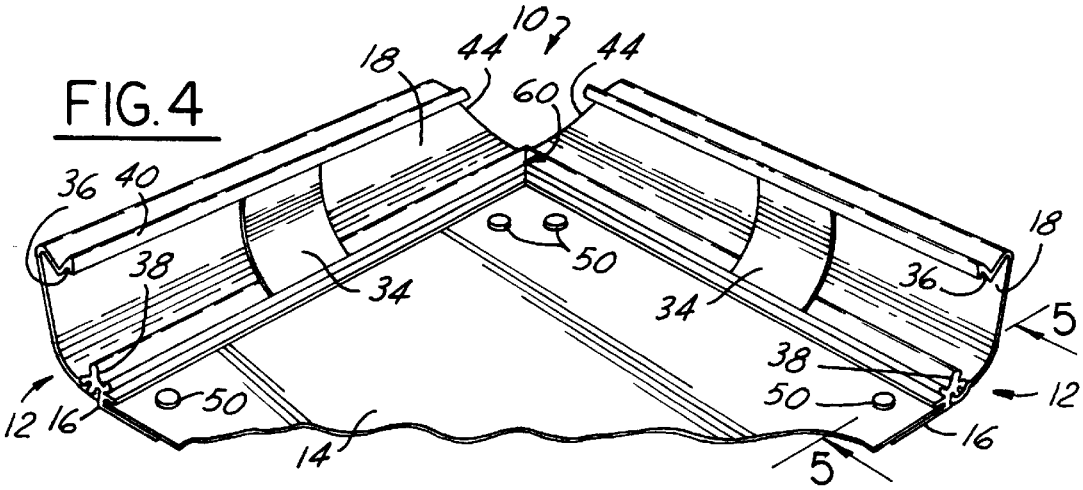
FIG. 4 is an enlarged perspective view of one of the corners of the poster frame device shown in FIG. 1, with adjacent cover members being shown in their "open" positions.

As shown in FIGS. 1 and 4, the mating ends of the frame sections 12 are cut and mitered at 45° angles, as shown by the reference numeral 44. In this manner, when the frame sections 12 are positioned around the backing member to form the poster frame device 10, a continuous frame is formed.

Figure 5:
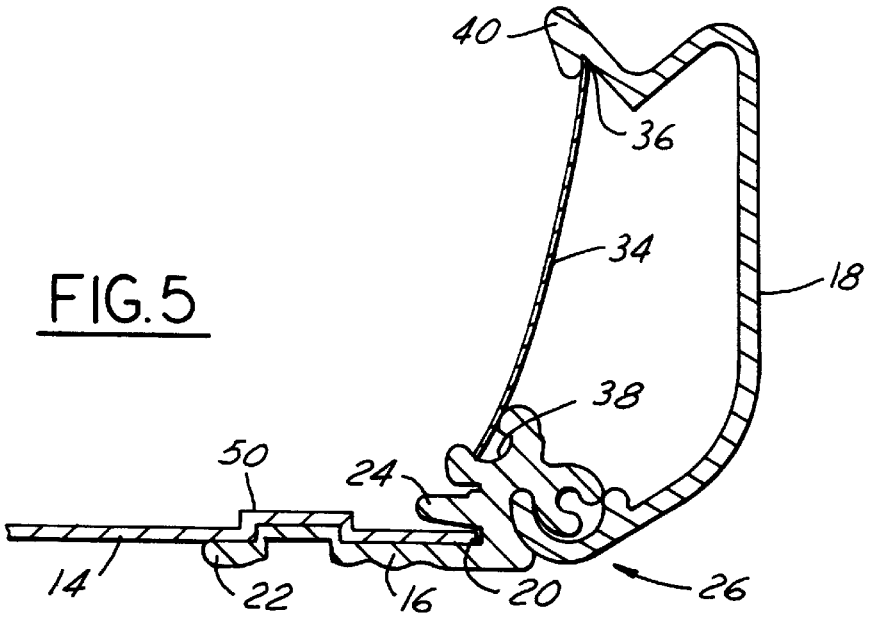
FIG. 5 is a cross-sectional view of the poster frame mechanism shown in FIG. 4, with the cross-section being taken along line 5—5 in FIG. 4 and in the direction of the arrows.

The frame sections 12 are preferably staked or swaged to the backing member 14. This is better shown in FIG. 5. FIG. 5 is a cross-section of a portion of the enlarged perspective view of a corner of the poster frame device 10 as shown in FIG. 4. By use of a conventional staking machine, a plurality of locking mechanisms 50 (a/k/a "Tog-L-Locs") are positioned around the periphery of the backing member 14. As best shown in FIG. 5, the staking procedure displaces a portion of the material of the backing member and base member 16 to form an interlocking mechanism 50. The interlocking mechanism 50 securely holds the backing member 14 to each of the frame sections 12 thereby forming a rigid and complete poster frame device 10.

Although only one preferred method is shown for securely attaching the backing member to the frame sections, other similar or equivalent methods or mechanisms could be used in accordance with the present invention. It is also possible to use mechanical-type fasteners, such as screws or individual fasteners, although these would add additional cost and assembly time.

With the present invention, it is not necessary to use corner keys, corner members or any other type of corner devices which hold the frame sections 12 together in the final configuration. By simply staking or securely affixing the backing member to each of the frame sections 12 in the manner shown, a rigid complete poster frame device 10 is formed and provided. The poster display device 10 allows rotation of cover members 18 relative to base member 16 around the periphery of the poster frame device, thereby providing a convenient front-loading poster frame. The poster frame device is simple and economical to manufacture and has a minimum of parts.

Use of the sheet metal joining mechanisms 50 eliminates the necessity for use of rail locks, corner keys, or other devices conventionally used to hold the members of the frame sections together, and to hold the frame sections to the backing member. Corner keys are separate L-shaped members which are adapted to fit within grooves or channels in adjacent frame sections, and typically are secured in place with fasteners. The elimination of such grooves or channels allows the reduction in the size of the base member 16 saving material and cost.

The mitered intersecting corners 44 of the frame sections prevent the cover members 18 from sliding longitudinally or being displaced longitudinally relative to the base member 16. As shown in FIG. 4, the portions 60 of the cover member 18 adjacent the hinge mechanism 26 abut and are in contact with one another at each of the corners. This prevents the corner members from sliding longitudinally relative to their respective base members.

Figure 7:
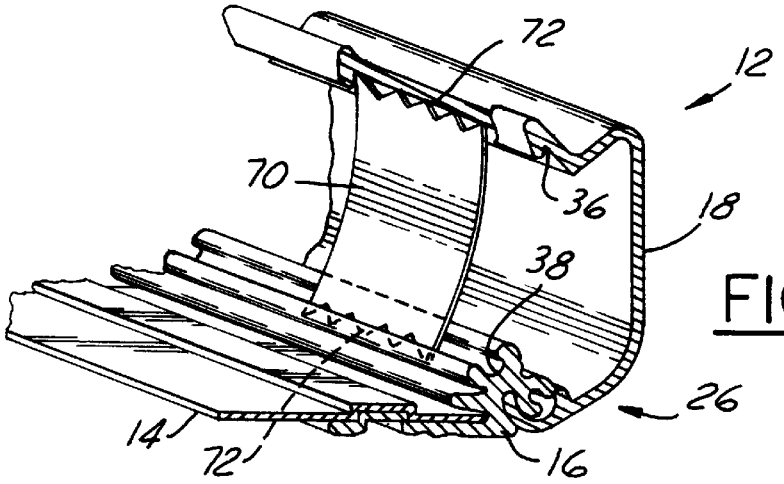
FIG. 7 illustrates an alternate spring member which can be used with the present invention.

If desired, it is also possible to use serrated or "toothed" spring members 70, as shown in FIG. 7, with the present invention. The teeth 72 on the edges of the spring members dig into the channels or grooves 36 and 38 in the cover and base members 18 and 16, respectively, and help prevent any longitudinal movement of the corner members relative to the base members when the frame sections are repeatedly opened and closed.

While the best modes for carrying out the invention have been described in detail, those familiar with the art to which this invention relates will recognize various alternative designs and embodiments for practicing the invention as defined by the following claims.

What is claimed is:

1. A front-loading poster frame device, comprising:

a backing member; and a plurality of frame sections positioned around the periphery of said backing member;

each of said frame sections being mitered at 45° at their outer ends and each having a base member and a cover member hingedly connected thereto;

at least one spring member positioned in each frame section extending between and biasing together said base member and said cover member, said spring member having at least a first and second sharp projection thereon, said first sharp projection for embedding in said base member and said second sharp projection for embedding in said cover member, said first sharp projection and said second sharp projection preventing said base member and said cover member from sliding longitudinally relative to one another; and an interlocking mechanism coupling said base member and said backing member, said interlocking mechanism having a displaced portion of said base member coupled within said backing member;

wherein the front-loading poster frame device is formed from the plurality of frame sections without any corner key members needed to hold the frame sections together and without any rail locks needed to keep said cover members and base members in longitudinal alignment.

2. The poster frame device of claim 1 wherein said base member and cover member are hingedly connected together with a hinge mechanism, said hinge mechanism comprising an elongated ball-type pintle member on said base members and an elongated pocket member on said cover member.

3. The poster frame device of claim 2 wherein said pintle member has at least one elongated slot therein in order to delete mass therefrom.

4. A front-loading poster frame device, comprising:

a backing member having four side edges; and four frame sections positioned around the periphery of said backing member, one of said frame sections being positioned on each of said side edges;

each of said frame sections being mitered at 45° at its outer end and each having a base member and a cover member hingedly connected together;

at least one spring member positioned in each frame section extending between and biasing together said base member and said cover member, said spring member having at least a first and second sharp projection thereon, said first sharp projection for embedding in said base member and said second sharp projection for embedding in said cover member, said first sharp projection and said second sharp projection preventing said base member and said cover member from sliding longitudinally relative to one another, and an interlocking mechanism coupling said base member and said backing member, said interlocking mechanism having a displaced portion of said base member coupled within said backing member;

wherein the front-loading poster frame device is formed from the plurality of frame sections without any corner key members needed to hold the frame sections together and without any rail locks needed to keep said cover members and base members in longitudinal alignment.

5. The poster frame device of claim 4, wherein said base member and cover member are hingedly connected together with a hinge mechanism, said hinge mechanism comprising an elongated ball-type pintle member on said base member and an elongated socket member on said cover member.

6. The poster frame device of claim 5 wherein said pintle member has at least one elongated slot therein in order to delete mass therefrom.

7. A front-loading poster frame device, comprising:

a backing member; and a plurality of frame sections positioned around the periphery of said backing member;

each of said frame sections being mitered at 45° at its outer end and each having a base member and a cover member hingedly connected together;

at least one spring member positioned in each frame section extending between and biasing together said base member and said cover member, said spring member having at least a first and second sharp projection thereon, said first sharp projection for embedding in said base member and said second sharp projection for embedding in said cover member, said first sharp protection and said second sharp projection preventing said base member and said cover member from sliding longitudinally relative to one another; and an interlocking mechanism coupling said base member and said backing member, said interlocking mechanism having a displaced portion of said base member coupled within said backing member;

each of said base members and cover members being hingedly connected together with a hinge mechanism, said hinge mechanism comprising an elongated ball-type pintle member on said base members and an elongated socket member on said cover members;

said pintle member having at least one elongated slot therein in order to delete mass therefrom; and, wherein the front-loading poster frame device is formed from the plurality of frame sections without any corner key members needed to hold the frame sections together and without any rail locks needed to keep said cover members and base members in longitudinal alignment.

* * * * *